US008221131B1

(12) United States Patent
Mazyck

(10) Patent No.: US 8,221,131 B1
(45) Date of Patent: Jul. 17, 2012

(54) SEQUENTIALLY CONNECTABLE ELECTRICAL OUTLET SYSTEM HAVING MALE AND FEMALE ELECTRICAL OUTLETS ROTATABLY CONNECTED

(76) Inventor: Darren Mazyck, Miramar, FL (US)

( * ) Notice: Subject to any disclaimer, the term of this patent is extended or adjusted under 35 U.S.C. 154(b) by 0 days.

(21) Appl. No.: 13/115,406

(22) Filed: May 25, 2011

(51) Int. Cl.
*H01R 39/00* (2006.01)
*H01R 4/60* (2006.01)

(52) U.S. Cl. ..... 439/13; 439/214

(58) Field of Classification Search ..... 439/76.1, 439/76.2, 72, 214, 145, 147, 652; 362/145, 362/147
See application file for complete search history.

(56) References Cited

U.S. PATENT DOCUMENTS

| | | | | |
|---|---|---|---|---|
| 4,856,999 | A | 8/1989 | Flohr | |
| 5,658,158 | A | 8/1997 | Milan | |
| 6,062,884 | A * | 5/2000 | Messimer et al. | 439/172 |
| 6,210,189 | B1 | 4/2001 | Gantt | |
| 6,371,815 | B1 * | 4/2002 | Wetzel et al. | 439/651 |
| 6,520,787 | B1 * | 2/2003 | Lott | 439/218 |
| 6,755,676 | B2 | 6/2004 | Milan | |
| 7,066,616 | B2 * | 6/2006 | Howell | 362/145 |
| 7,220,145 | B2 | 5/2007 | Denovich et al. | |
| 7,658,505 | B2 * | 2/2010 | Howell | 362/147 |
| 2001/0018277 | A1 * | 8/2001 | Gerard et al. | 439/13 |
| 2009/0156061 | A1 * | 6/2009 | Bernstein | 439/652 |

* cited by examiner

*Primary Examiner* — Chandrika Prasad
(74) *Attorney, Agent, or Firm* — Albert Bordas, P.A.

(57) ABSTRACT

A sequentially connectable electrical outlet system, having a unisex plug assembly having first male and female swivel assemblies, and first male and female lock assemblies. A male outlet assembly has a second male swivel assembly and a second male lock assembly. The unisex plug assembly and the male outlet assembly are rotatably connected. A female outlet assembly has a second female swivel assembly and a second female lock assembly. The unisex plug assembly and the female outlet assembly are rotatably connected. At least two unisex outlet assemblies each comprise third male and female swivel assemblies, and third male and female lock assemblies. The at least two unisex outlet assemblies rotatably connected to the unisex plug assembly. A reel assembly defines a cavity to receive the unisex plug assembly, the male and female outlet assemblies, and the at least two unisex outlet assemblies.

20 Claims, 5 Drawing Sheets

SEQUENTIALLY CONNECTABLE ELECTRICAL OUTLET SYSTEM HAVING MALE AND FEMALE ELECTRICAL OUTLETS ROTATABLY CONNECTED

BACKGROUND OF THE INVENTION

1. Field of the Invention

The present invention relates to electrical outlets, and more particularly, to sequentially connectable electrical outlet systems.

2. Description of the Related Art

Applicant believes that one of the closest references corresponds to U.S. Pat. No. 5,658,158 issued to Milan on Aug. 19, 1997 for a modular surge protection system with interchangeable surge protection modules. However, it differs from the present invention because Milan teaches a modular surge protection system having interchangeable power supply and surge protection modules connectable to a power distribution module. The power distribution module provides surge protection for the power supply modules while independent surge protection is provided in the surge protection modules.

Applicant believes that another reference corresponds to U.S. Pat. No. 6,755,676 issued to Milan on Jun. 29, 2004 for a modular outlet strip. However, it differs from the present invention because Milan teaches a modular surge protection system having a power distribution module connected to at least one surge protection module in a coplanar relationship. The power distribution module has a housing and surge protection disposed in the housing. At least one female electrical outlet is disposed on the housing and is electrically connected to the surge protection. A first portion formed on the housing connects with a corresponding second portion on the surge protection module to secure the modules together in a coplanar relationship.

Applicant believes that another reference corresponds to U.S. Pat. No. 7,220,145 issued to Denovich, et al. on May 22, 2007 for a patch panel system. However, it differs from the present invention because Denovich, et al. teach a patch panel system that comprises a frame, a patch panel and connector ports. The patch panel is attached to the frame and has first and second connectivity interfaces. The first connectivity interface has multiple sections joined to form an N-sided portion of a polygon where N is greater than 2. The connector ports are provided at the first connectivity interface. The sections of the first connectivity interface have planar front surfaces that are oriented at obtuse angles to one another.

Applicant believes that another reference corresponds to U.S. Pat. No. 4,856,999 issued to Flohr on Aug. 15, 1989 for an electric adapter connector. However, it differs from the present invention because Flohr teaches a handy pentaprism-shaped connector that has on its sides plug pin arrangements (2) for five different plugging systems and contains a revolving body (4, 7) which has in the area of the top and/or bottom surface of the connector sockets for two more plugging systems. These can be manually snapped (8, 9) into contact (3, 5, 6) with the plug pin arrangement (2) of the connector needed at any time, the remaining plug pins being then absolutely deprived of any voltage.

Applicant believes that another reference corresponds to U.S. Pat. No. 6,210,189 issued to Gantt on Apr. 3, 2001 for a rigid Christmas light installation system. However, it differs from the present invention because Gantt teaches a Christmas light system including a plurality of rigid housings each having a couple mounted on each end thereof and a side face with a plurality of sockets mounted thereon for accepting a bulb therein. The sockets are each connected between the couples for providing electrical communication therebetween. The housings may be releasably coupled end-to-end in fixed relationship for providing electrical communication therebetween.

Other patents describing the closest subject matter provide for a number of more or less complicated features that fail to solve the problem in an efficient and economical way. None of these patents suggest the novel features of the present invention.

SUMMARY OF THE INVENTION

The instant invention is a sequentially connectable electrical outlet system, comprising a unisex electrical plug assembly having first male and female swivel assemblies, and first male and female lock assemblies. A male electrical outlet assembly comprises a second male swivel assembly and a second male lock assembly. The unisex electrical plug assembly and the male electrical outlet assembly are rotatably connected. A female electrical outlet assembly comprises a second female swivel assembly and a second female lock assembly. The unisex electrical plug assembly and the female electrical outlet assembly are also rotatably connected. At least two unisex electrical outlet assemblies each comprise third male and female swivel assemblies, and third male and female lock assemblies. The at least two unisex electrical outlet assemblies rotatably connected to the unisex electrical plug assembly.

The at least two unisex electrical outlet assemblies are positioned and rotatably connected between the male and female electrical outlet assemblies. The first female swivel assembly receives the third male swivel assembly of a first at least two unisex electrical outlet assemblies, and the first female lock assembly receives the third male lock assembly of the first at least two unisex electrical outlet assemblies. The third female swivel assembly of the first at least two unisex electrical outlet assemblies receives the second male swivel assembly and the third female lock assembly of the first at least two unisex electrical outlet assemblies receives the second male lock assembly. The third female swivel assembly of a second at least two unisex electrical outlet assemblies receives the first male swivel assembly and the third female lock assembly of the second at least two unisex electrical outlet assemblies receives the first male lock assembly. The second female swivel assembly receives the third male swivel assembly of the second at least two unisex electrical outlet assemblies and the second female lock assembly receives the third male lock assembly of the second at least two unisex electrical outlet assemblies.

The first and second male swivel assemblies each comprise a swivel tube that extends a predetermined distance from the unisex electrical plug assembly and the male electrical outlet assembly respectively. The swivel tube comprises a distal end having a narrow edge and a wider edge. The first and second female swivel assemblies each comprise a through hole and a stationary pin. Each stationary pin limits travel of the first and second male swivel assemblies respectively when the respective wider edge reaches the respective stationary pin. The first and second male lock assemblies each comprise a spring contained within cavities defined in the unisex electrical plug assembly and the male electrical outlet assembly respectively. Each spring applies a spring force upon a respective bearing. The first and second female lock assemblies each comprise a channel extending between at least two indents.

The unisex electrical plug assembly comprises a switch and further characterized in that electrical wiring extends from the unisex electrical plug assembly to the male and female electrical outlet assemblies. The electrical wiring includes hot, grounding, and neutral wiring.

A reel assembly defines a cavity to receive the unisex electrical plug assembly, the male and female electrical outlet assemblies, and the at least two unisex electrical outlet assemblies when they are in a predetermined configuration. The reel assembly comprises first and second reel plates. The first reel plate has an off-centered knob assembly rotatably mounted thereon and a centered handle assembly mounted thereon. Electrical blades of the unisex electrical plug assembly face the first reel plate and slots of the male and female electrical outlet assemblies and the at least two unisex electrical outlet assemblies face the second reel plate when the cavity receives the unisex electrical plug assembly, the male and female electrical outlet assemblies, and the at least two unisex electrical outlet assemblies. The first reel plate comprises a cutout to permit the electrical blades of the unisex electrical plug assembly to extend therethrough when the cavity receives the unisex electrical plug assembly, the male and female electrical outlet assemblies, and the at least two unisex electrical outlet assemblies.

It is therefore one of the main objects of the present invention to provide a sequentially connectable electrical outlet system that may be configured into various shapes.

It is another object of this invention to provide a sequentially connectable electrical outlet system comprising a reel assembly and an electrical outlet assembly.

It is another object of this invention to provide a sequentially connectable electrical outlet system that is volumetrically efficient for carrying, transporting, and storage.

It is another object of this invention to provide a sequentially connectable electrical outlet system that can be readily configured into various shapes without the need of any special tools.

It is another object of this invention to provide a sequentially connectable electrical outlet system, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 3:
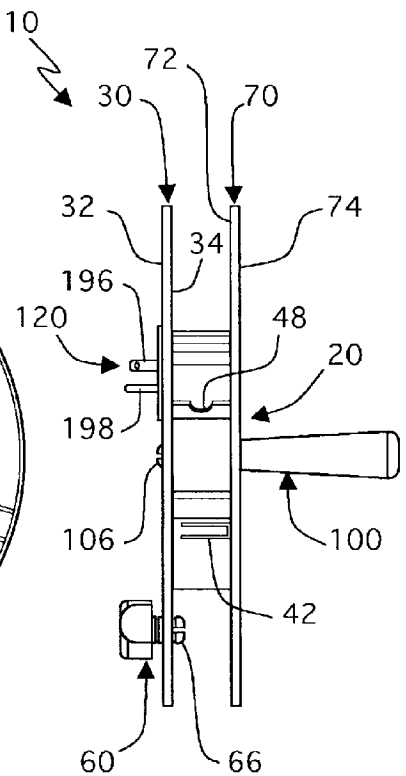
FIG. 3 is a side elevational view of the instant invention.

Referring now to the drawings, the present invention is a sequentially connectable electrical outlet system and is generally referred to with numeral 10. It can be observed that it basically includes reel assembly 20, and electrical outlet assembly 120.

Figure 2:
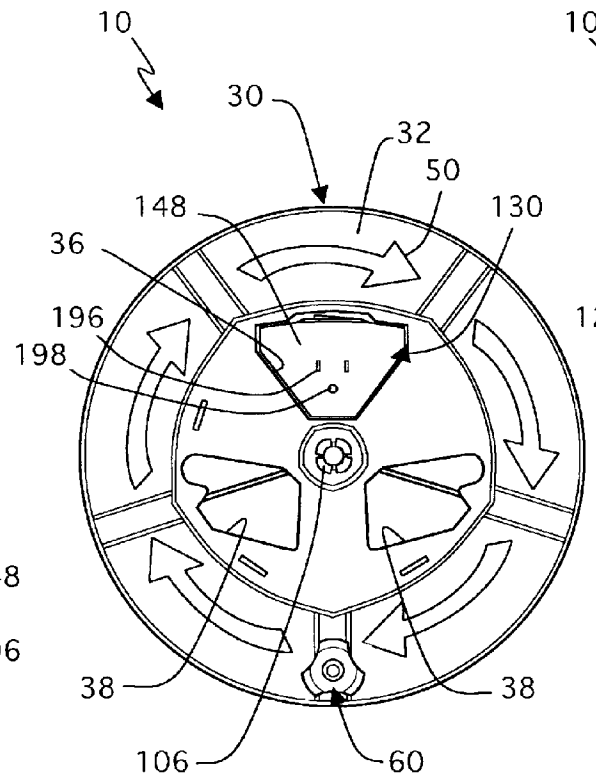
FIG. 2 is a rear elevational view of the instant invention.
Figure 1:
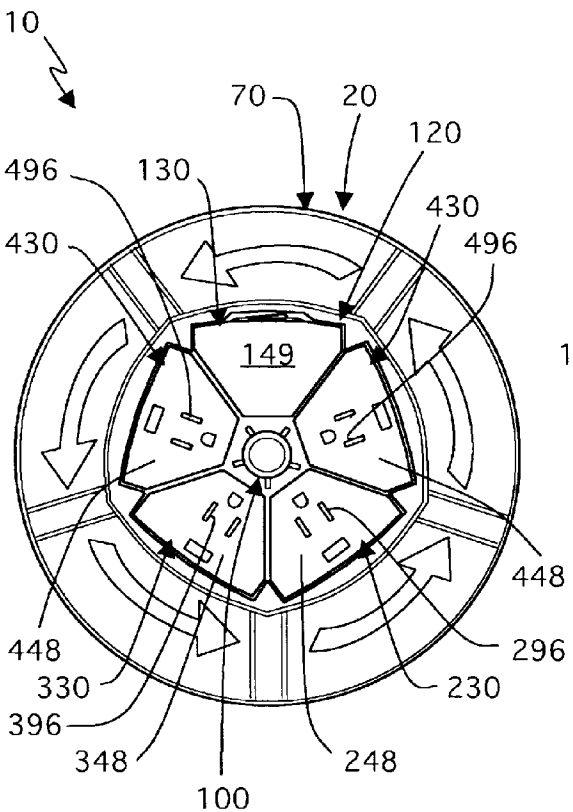
FIG. 1 represents a front elevational view of the instant invention.

As seen in FIGS. 1, 2, and 3, reel assembly 20 defines a cavity to receive electrical outlet assembly 120. Specifically, reel assembly 20 defines a cavity to receive unisex electrical plug assembly 130, male and female electrical outlet assemblies 230 and 330 respectively, and at least two unisex electrical outlet assemblies 430 when they are in a predetermined configuration. In a preferred embodiment, the predetermined configuration is generally toroid in shape, whereby unisex electrical plug assembly 130, male and female electrical outlet assemblies 230 and 330 respectively, and at least two unisex electrical outlet assemblies 430 are sequentially connected.

In the preferred embodiment, electrical blades 196 and grounding prong 198 of unisex electrical plug assembly 130 face first reel plate 30. Slots 296, 396, and 496 of male and female electrical outlet assemblies 230 and 330 respectively, and at least two unisex electrical outlet assemblies 430 face second reel plate 70 when the cavity receives unisex electrical plug assembly 130, male and female electrical outlet assemblies 230 and 330 respectively, and at least two unisex electrical outlet assemblies 430. First reel plate 30 comprises cutout 36 to permit electrical blades 196 of the unisex electrical plug assembly 130 to extend therethrough when the cavity receives unisex electrical plug assembly 130, male and female electrical outlet assemblies 230 and 330 respectively, and at least two unisex electrical outlet assemblies 430.

As seen in FIGS. 4A, 4B, 4C, 4D, 4E, 4F, and 4G, electrical outlet assembly 120 comprises unisex electrical plug assembly 130, male and female electrical outlet assemblies 230 and 330 respectively, and at least two unisex electrical outlet assemblies 430 that are sequentially connected and may be configured into a multitude of configurations depending on the utility instant invention 10 is serving.

Figure 5:
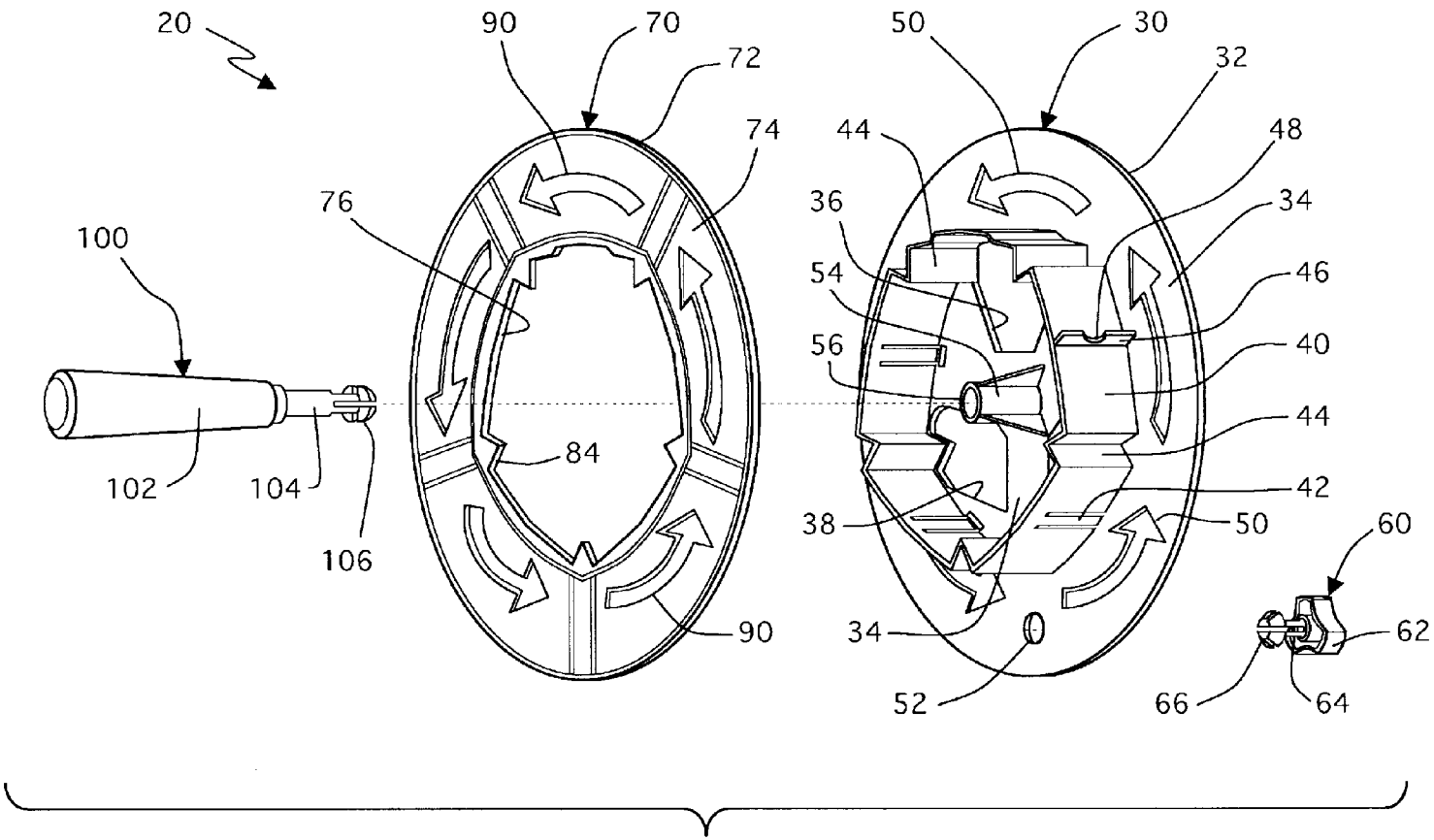
FIG. 5 is an exploded view of the reel assembly.

As seen in FIG. 5, reel assembly 20 comprises first and second reel plates 30 and 70 respectively. First reel plate 30 has off-centered knob assembly 60 rotatably mounted thereon and centered handle assembly 100 mounted thereon.

Knob assembly 60 comprises knob 62, neck 64, and retaining lock 66. Knob assembly 60 is fixed so that retaining lock 66 snaps into hole 52. First reel plate 30 also has directional arrows 50. Handle assembly 100 comprises handle 102, neck 104, and retaining lock 106. Handle assembly 100 is fixed so that retaining lock 106 snaps into hole 56 of housing 54 that protrudes from first reel plate 30.

First reel plate 30 comprises exterior face 32 and interior face 34 having cutouts 36 and 38. Cutout 36 has a cooperative shape and dimension to receive unisex electrical plug assembly 130. Protruding from interior face 34 is sidewall 40. Sidewall 40 comprises at least one retaining clip 42 and at least one pronounced sections 44. In the preferred embodiment, at least one pronounced sections 44 each form a vertex. Extending from sidewall 40 is locking tab 46 comprising notch 48. In operation, an electrical extension cord having a plug and a female connector, not seen, may be coiled onto reel assembly 20. As an example, the plug of the electrical extension cord may be secured with locking tab 46 and notch 48, and the electrical extension cord may be coiled over sidewall 40 and between first and second reel plates 30 and 70 respectively. The female connector of the electrical extension cord may be mounted onto unisex electrical plug assembly 130.

Second reel plate 70 comprises exterior face 74 and interior face 72 having directional arrows 90 and cutout 76. Second reel plate 70 comprises at least one pronounced sections 84 that overlap with at least one pronounced sections 44. Thus, in the preferred embodiment, the at least one pronounced sections 84 each also form a vertex.

Figure 6A:
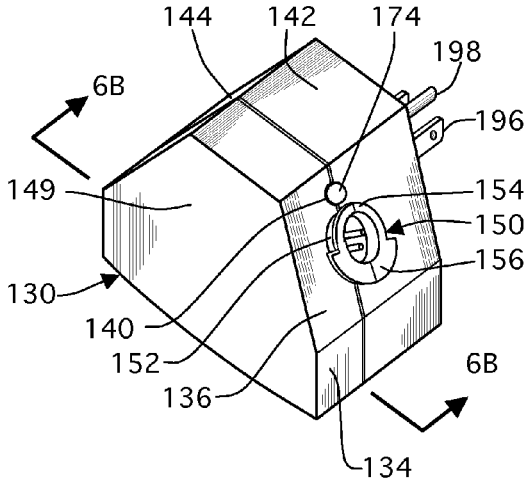
FIG. 6A is an isometric view of the unisex electrical plug assembly.
Figure 6B:
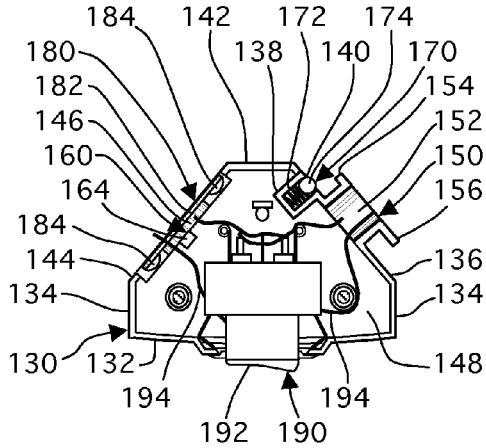
FIG. 6B is a cross-section view of the unisex electrical plug assembly taken along lines 6B-6B seen in FIG. 6A.

Seen in FIGS. 6A and 6B is unisex electrical plug assembly 130 having first male and female swivel assemblies 150 and 160 respectively, and first male and female lock assemblies 170 and 180 respectively. Unisex electrical plug assembly 130 further comprises switch wall 132, sidewalls 134, angled wall 136 having cavity 138; cavity 138 has edge 140 that is slightly taped inwardly to contain bearing 174; unisex electrical plug assembly 130 further comprises narrow wall 142, angled wall 144 having edge 146, wall 148 and wall 149 to define a housing. Unisex electrical plug assembly 130 comprises switch assembly 190 having switch 192, and electrical wiring 194 that extends from unisex electrical plug assembly 130 to male and female electrical outlet assemblies 230 and 330 respectively. Electrical wiring 194 includes hot, grounding, and neutral wiring.

Figure 7A:
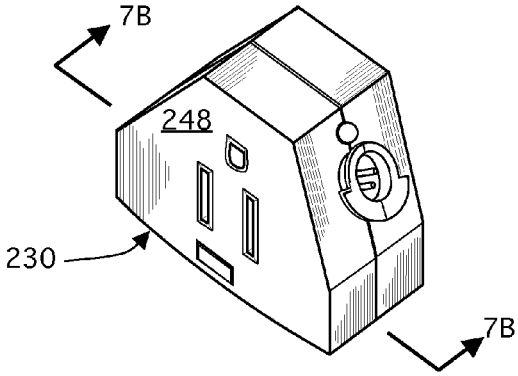
FIG. 7A is an isometric view of a male electrical outlet assembly.
Figure 7B:
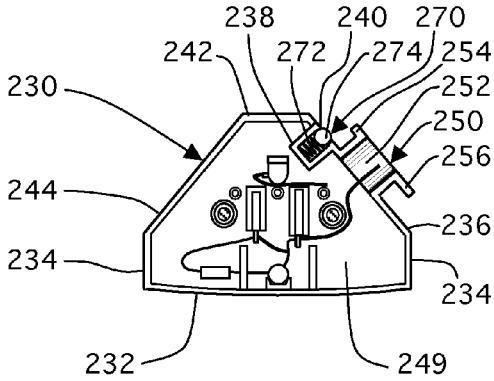
FIG. 7B is a cross-section view of the male electrical outlet assembly taken along lines 7B-7B seen in FIG. 7A.

Seen in FIGS. 7A and 7B is male electrical outlet assembly 230 having second male swivel assembly 250, and second male lock assembly 270. Unisex electrical plug assembly 130 and male electrical outlet assembly 230 are rotatably connected. Male electrical outlet assembly 230 further comprises wall 232, sidewalls 234, angled wall 236 having cavity 238; cavity 238 has edge 240 that is slightly taped inwardly to contain bearing 274; male electrical outlet assembly 230 further comprises narrow wall 242, angled wall 244, wall 248, and wall 249 to define a housing.

Figure 8A:
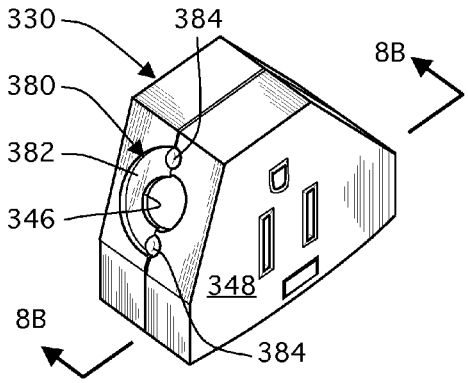
FIG. 8A is an isometric view of a female electrical outlet assembly.
Figure 8B:
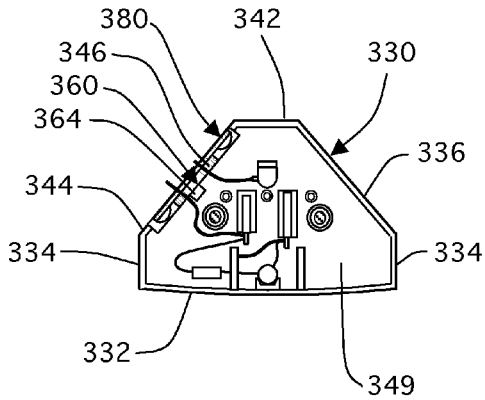
FIG. 8B is a cross-section view of the female electrical outlet assembly taken along lines 8B-8B seen in FIG. 8A.

Seen in FIGS. 8A and 8B is female electrical outlet assembly 330 having second female swivel assembly 360 and second female lock assembly 380. Unisex electrical plug assembly 130 and female electrical outlet assembly 330 are also rotatably connected. Female electrical outlet assembly 330 further comprises wall 332, sidewalls 334, angled wall 336, narrow wall 342, angled wall 344 having edge 346, wall 348, and wall 349 to define a housing.

Figure 9A:
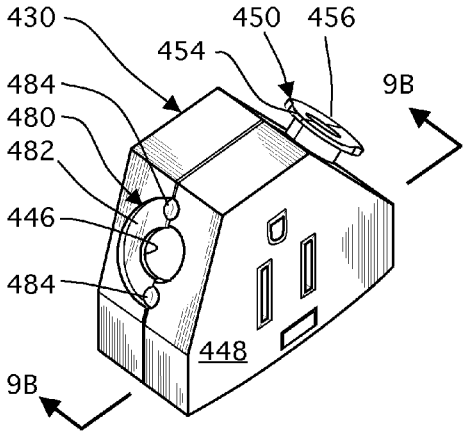
FIG. 9A is an isometric view of a unisex electrical outlet assembly.
Figure 9B:
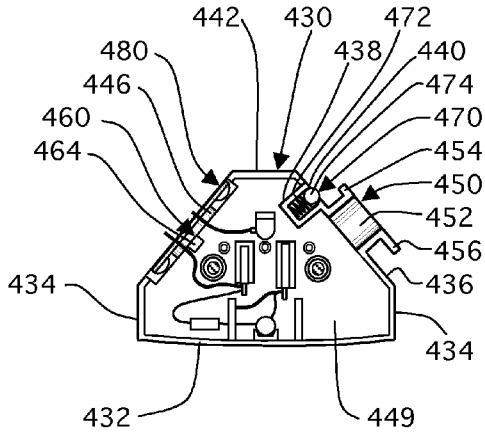
FIG. 9B is a cross-section view of the unisex electrical outlet assembly taken along lines 9B-9B seen in FIG. 9A.

Seen in FIGS. 9A and 9B is unisex electrical outlet assembly 430 having third male and female swivel assemblies 450 and 460 respectively, and third male and female lock assemblies 470 and 480 respectively. At least two unisex electrical outlet assemblies 430 are rotatably connected to the unisex electrical plug assembly 130. Unisex electrical outlet assembly 430 further comprises wall 432, sidewalls 434, angled wall 436 having cavity 438; cavity 438 has edge 440 that is slightly taped inwardly to contain bearing 474; unisex electrical outlet assembly 430 further comprises narrow wall 442, angled wall 434 having edge 446, wall 448 and wall 449 to define a housing.

Figure 4A:
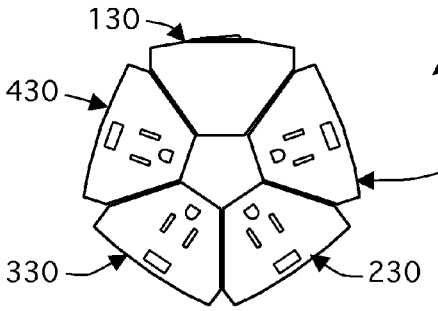
FIG. 4A is a front elevational view of the electrical outlet assembly in a first configuration.
Figure 4B:
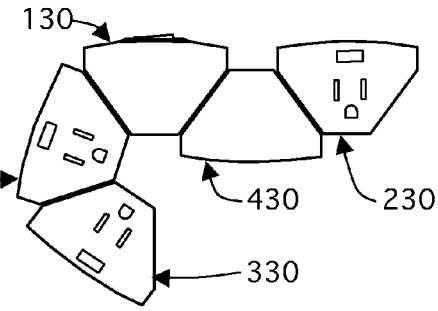
FIG. 4B is a front elevational view of the electrical outlet assembly in a second configuration.
Figure 4C:
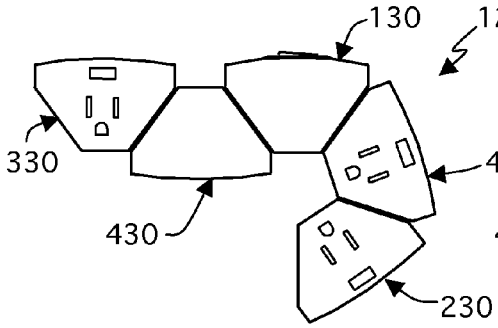
FIG. 4C is a front elevational view of the electrical outlet assembly in a third configuration.
Figure 4D:
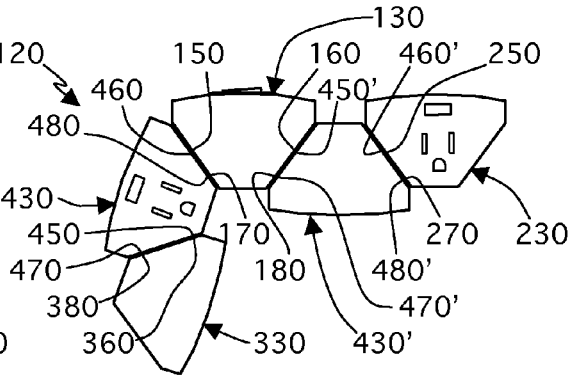
FIG. 4D is a front elevational view of the electrical outlet assembly in a fourth configuration.
Figure 4E:
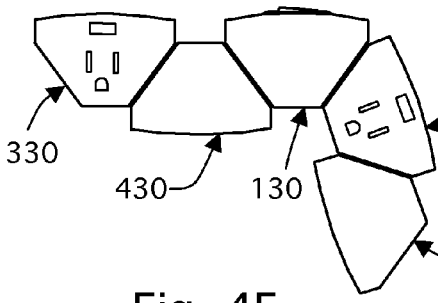
FIG. 4E is a front elevational view of the electrical outlet assembly in a fifth configuration.
Figure 4F:
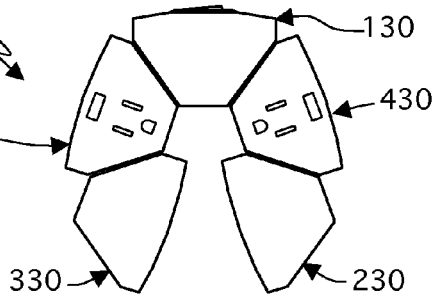
FIG. 4F is a front elevational view of the electrical outlet assembly in a sixth configuration.
Figure 4G:
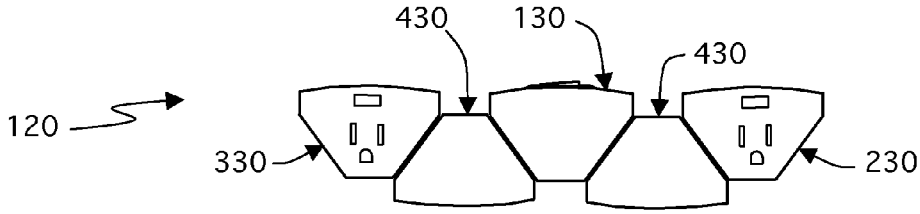
FIG. 4G is a front elevational view of the electrical outlet assembly in a seventh configuration.

As seen in FIGS. 4A, 4B, 4C, 4D, 4E, 4F, and 4G, in a preferred embodiment, at least two unisex electrical outlet assemblies 430 are positioned and rotatably connected between male and female electrical outlet assemblies 230 and 330 respectively. For purposes of this example, as illustrated in FIG. 4D, a first unisex electrical outlet assembly 430 is defined "without prime", and a second unisex electrical outlet assembly 430 is defined with "prime", whereby first female swivel assembly 160 receives third male swivel assembly 450' and first female lock assembly 180 receives third male lock assembly 470', and third female swivel assembly 460' receives second male swivel assembly 250 and third female lock assembly 480' receives second male lock assembly 270. Third female swivel assembly 460 receives first male swivel assembly 150 and third female lock assembly 480 receives first male lock assembly 170, and second female swivel assembly 360 receives third male swivel assembly 450 and second female lock assembly 380 receives third male lock assembly 470.

As best seen in FIGS. 6A and 6B, 7A and 7B, 8A and 8B, and 9A and 9B, first, second, and third male swivel assemblies 150, 250, and 450 comprise swivel tubes 152, 252, and 452 respectively that extend a predetermined distance from walls 136, 236, and 436 respectively. Swivel tubes 152, 252, and 452 comprise a distal end having narrow edge 154, 254, and 454 and wider edge 156, 256, and 456 respectively. First, second, and third female swivel assemblies 160, 360, and 460 respectively each comprise a through hole defined by edges 146, 346, and 446 respectively and have stationary pins 164, 364, and 464 respectively. Stationary pins 164, 364, and 464 limit travel of first, second, and third male swivel assemblies 150, 250, and 450 respectively when respective wider edges 156, 256, and 456 reach respective stationary pin 164, 364, and 464. First, second, and third male lock assemblies 170, 270, and 470 each comprise a spring 172, 272, and 472 respectively contained within cavities 138, 238, and 438 defined in unisex electrical plug assembly 130, male electrical outlet assembly 230, and unisex electrical outlet assembly 430 respectively. Springs 172, 272, and 472 each apply a spring force upon respective bearings 174, 274, and 474. First, second, and third female lock assemblies 180, 380, and 480 comprise channels 182, 382, and 482 extending between at least two indents 184, 384, and 484 respectively. Either of at least two indents 184, 384, and 484 receive respective bearings 174, 274, and 474 to lock each unisex electrical plug assembly 130, male and female electrical outlet assemblies 230 and 330, and at least two unisex electrical outlet assemblies 430 respectively in a particular configuration. In the preferred embodiment, unisex electrical plug assembly 130, male and female electrical outlet assemblies 230 and 330, and at least two unisex electrical outlet assemblies 430 each rotate up to 180 degrees.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sequentially connectable electrical outlet system, comprising:

A) a unisex electrical plug assembly comprising first male and female swivel assemblies, and first male and female lock assemblies;

B) a male electrical outlet assembly comprising a second male swivel assembly and a second male lock assembly, said unisex electrical plug assembly and said male electrical outlet assembly are rotatably connected; and C) a female electrical outlet assembly comprising a second female swivel assembly and a second female lock assembly, said unisex electrical plug assembly and said female electrical outlet assembly are also rotatably connected.

2. The sequentially connectable electrical outlet system set forth in claim 1, further comprising at least two unisex electrical outlet assemblies each comprising third male and female swivel assemblies, and third male and female lock assemblies, said at least two unisex electrical outlet assemblies rotatably connected to said unisex electrical plug assembly.

3. The sequentially connectable electrical outlet system set forth in claim 2, further characterized in that said at least two unisex electrical outlet assemblies are positioned and rotatably connected between said male and female electrical outlet assemblies.

4. The sequentially connectable electrical outlet system set forth in claim 2, further characterized in that said first female swivel assembly receives said third male swivel assembly of a first said at least two unisex electrical outlet assemblies, and said first female lock assembly receives said third male lock assembly of said first said at least two unisex electrical outlet assemblies.

5. The sequentially connectable electrical outlet system set forth in claim 4, further characterized in that said third female swivel assembly of said first said at least two unisex electrical outlet assemblies receives said second male swivel assembly and said third female lock assembly of said first said at least two unisex electrical outlet assemblies receives said second male lock assembly.

6. The sequentially connectable electrical outlet system set forth in claim 5, further characterized in that said third female swivel assembly of a second said at least two unisex electrical outlet assemblies receives said first male swivel assembly and said third female lock assembly of said second said at least two unisex electrical outlet assemblies receives said first male lock assembly.

7. The sequentially connectable electrical outlet system set forth in claim 6, further characterized in that said second female swivel assembly receives said third male swivel assembly of said second said at least two unisex electrical outlet assemblies and said second female lock assembly receives said third male lock assembly of said second said at least two unisex electrical outlet assemblies.

8. The sequentially connectable electrical outlet system set forth in claim 1, further characterized in that said first and second male swivel assemblies each comprises a swivel tube, said swivel tube comprising a distal end having a narrow edge and a wider edge.

9. The sequentially connectable electrical outlet system set forth in claim 1, further characterized in that said first and second female swivel assemblies each comprise a through hole and a stationary pin.

10. The sequentially connectable electrical outlet system set forth in claim 1, further characterized in that said first and second male swivel assemblies each comprises a swivel tube that extend a predetermined distance from said unisex electrical plug assembly and said male electrical outlet assembly respectively, said swivel tube comprising a distal end having a narrow edge and a wider edge, and said first and second female swivel assemblies each comprise a through hole and a stationary pin, each said stationary pin limits travel of said first and second male swivel assemblies respectively when respective said wider edge reaches respective said stationary pin.

11. The sequentially connectable electrical outlet system set forth in claim 1, further characterized in that said first and second male lock assemblies each comprise a spring contained within cavities defined in said unisex electrical plug assembly and said male electrical outlet assembly respectively, each said spring applies a spring force upon a respective bearing.

12. The sequentially connectable electrical outlet system set forth in claim 1, further characterized in that said first and second female lock assemblies each comprise a channel extending between at least two indents.

13. The sequentially connectable electrical outlet system set forth in claim 1, further characterized in that said first and second male lock assemblies each comprise a spring contained within cavities defined in said unisex electrical plug assembly and said male electrical outlet assembly respectively, each said spring applies a spring force upon a respective bearing, and said first and second female lock assemblies each comprise a channel extending between at least two indents.

14. The sequentially connectable electrical outlet system set forth in claim 1, further characterized in that said unisex electrical plug assembly comprises a switch and further characterized in that electrical wiring extends from said unisex electrical plug assembly to said male and female electrical outlet assemblies.

15. The sequentially connectable electrical outlet system set forth in claim 14, further characterized in that said electrical wiring includes hot, grounding, and neutral wiring.

16. The sequentially connectable electrical outlet system set forth in claim 1, further comprising a reel assembly that defines a cavity to receive said unisex electrical plug assembly and said male and female electrical outlet assemblies when they are in a predetermined configuration.

17. The sequentially connectable electrical outlet system set forth in claim 2, further comprising a reel assembly that defines a cavity to receive said unisex electrical plug assembly, said male and female electrical outlet assemblies, and said at least two unisex electrical outlet assemblies when they are in a predetermined configuration.

18. The sequentially connectable electrical outlet system set forth in claim 16, further characterized in that said reel assembly comprises first and second reel plates, said first reel plate having an off-centered knob assembly rotatably mounted thereon and a centered handle assembly mounted thereon.

19. The sequentially connectable electrical outlet system set forth in claim 17, further characterized in that electrical blades of said unisex electrical plug assembly face said first reel plate and slots of said male and female electrical outlet assemblies and said at least two unisex electrical outlet assemblies face said second reel plate when said cavity receives said unisex electrical plug assembly, said male and female electrical outlet assemblies, and said at least two unisex electrical outlet assemblies.

20. The sequentially connectable electrical outlet system set forth in claim 19, further characterized in that said first reel plate comprises a cutout to permit said electrical blades of said unisex electrical plug assembly to extend therethrough when said cavity receives said unisex electrical plug assembly, said male and female electrical outlet assemblies, and said at least two unisex electrical outlet assemblies.

* * * * *